United States Patent [19]

Switall

[11] Patent Number: 4,643,124

[45] Date of Patent: Feb. 17, 1987

[54] LIQUID COATING SUPPLY SYSTEM FOR A PRINTING PRESS BLANKET COATER

[75] Inventor: Thomas G. Switall, Wheeling, Ill.

[73] Assignee: Ryco Graphic Manufacturing, Inc., Wheeling, Ill.

[21] Appl. No.: 733,387

[22] Filed: May 13, 1985

[51] Int. Cl.[4] ..... B05C 1/08; B05C 11/10

[52] U.S. Cl. ..... 118/259; 118/262

[58] Field of Search ..... 118/259, 258, 262, 46

[56] References Cited

U.S. PATENT DOCUMENTS

| | | | |
|---|---|---|---|
| 3,097,968 | 7/1963 | Schaefer | 118/259 |
| 3,410,713 | 11/1968 | Schneidereit | 118/259 X |
| 3,511,693 | 5/1970 | Davidson | 118/259 X |

*Primary Examiner*—John P. McIntosh

*Attorney, Agent, or Firm*—Lee, Smith & Zickert

[57] ABSTRACT

A liquid coating supply system for a printing press blanket coater is disclosed. The system includes a vessel for holding a supply of the liquid coating material, the holding tray for holding a portion of the liquid coating material for pick up by a feed roller, a first liquid transfer means for transfering the liquid coating material from the supply vessel to the holding tray and a second liquid transfer means for transfering the liquid coating material from the holding tray to the supply vessel. The first liquid transfer means has an adjustable flow valve for regulating the liquid flow from that transfer means, and a supply pump between the supply vessel and the adjustable flow valve for withdrawing the coating material from the supply vessel and for forcing the material through the valve under a pressure which is dependent upon the adjustment of the flow valve. A pressure responsive means between the pump and the adjustable valve conducts liquid flowing from the pump back to the supply vessel when the pressure between the pump and the adjustable valve exceeds a predetermined value.

5 Claims, 1 Drawing Figure

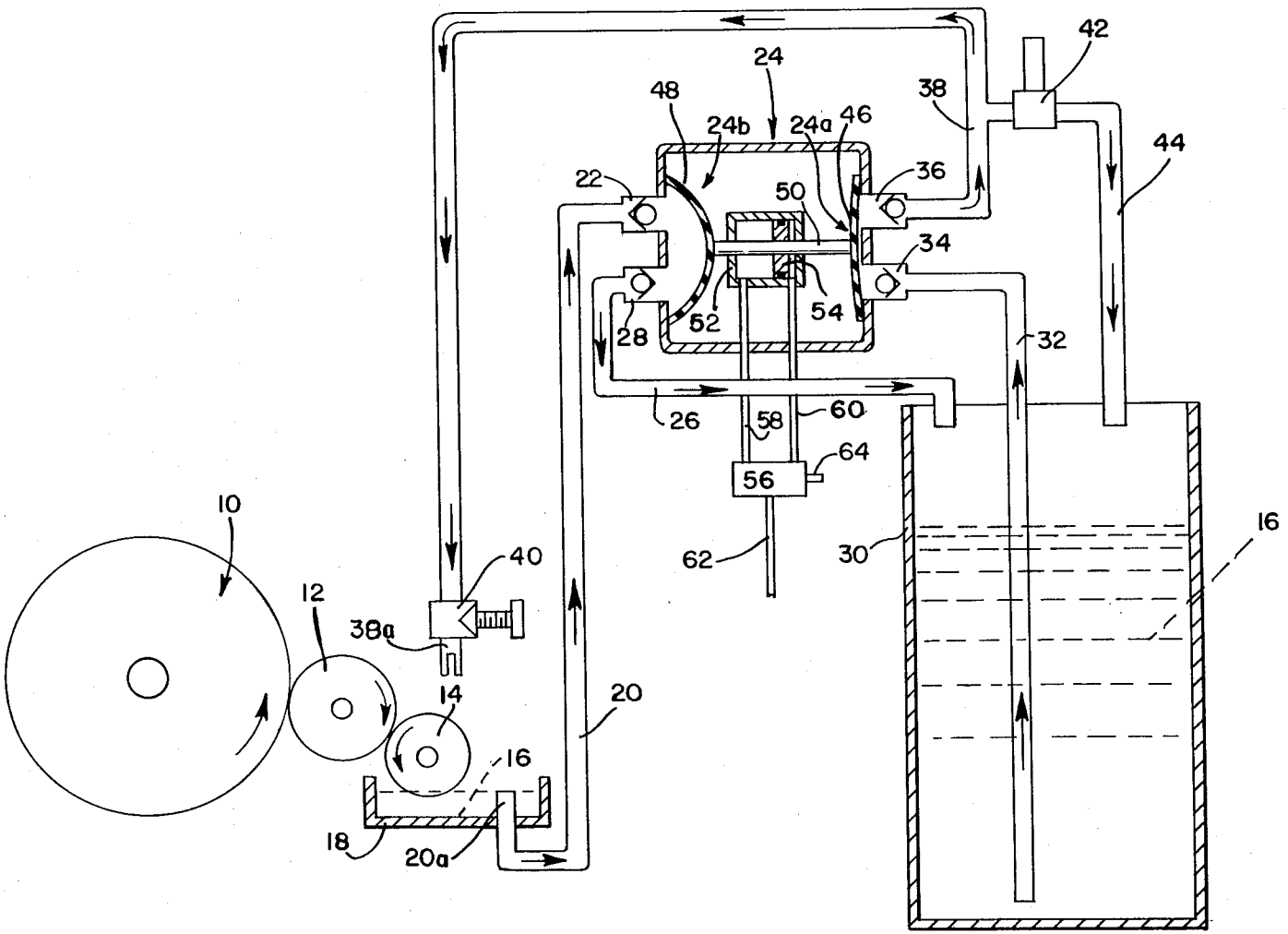
16
44
42
32
38
36
34
46
24a
24
50
54
60
64
30
24b
48
52
58
56
62
26
28
22
20
40
16
14
20a
38a
18
12
10

LIQUID COATING SUPPLY SYSTEM FOR A PRINTING PRESS BLANKET COATER

BACKGROUND AND SUMMARY OF THE INVENTION

This invention relates to a liquid coating supply system for a coater which applies the liquid coating material to the blanket cylinder of a web offset printing press for coating the printed paper as it is moving through the press. The coating material may be an aqueous coating which when dry renders the printed paper resistant to moisture and oils and prevents smearing. The coated paper may have a glossy or matte finish.

It has become common practice to utilize a coater for applying a liquid coating material to the blanket of a web offset printing press so that the printed sheet which is moving through the press can be coated. These coaters generally utilize a tray for holding the liquid coating material and a feed roller rotating in the liquid coating material in the tray. A coater roller is in rotating engagement with the feed roller and also in rotating engagement with the blanket roller of the printing press. The coating material is picked up from the tray by the feed roller, transfered to the coater roller, and retransfered to the blanket by the coater roller.

In this system it is important to maintain a pool of coating material in the tray and also to constantly recirculate the coating material so that the material is constantly entering the tray and constantly leaving the tray in the recirculation system.

Previous systems required continuous attention by the operator and adjustments to make sure that the system did not starve or overflow. Since the coating material is generally a sticky, varnish-like material considerable difficulty would result if the tray were to overflow into the works of the printing press. If the system is starved, i.e., has an undersupply of coating material, the tray will run dry and the coating material will not be transferred to the blanket and the printed sheet will not be properly coated.

It is necessary that the amount of liquid coating delivered to the tray be at least equal to that taken up by the feed roller and deposited by the coater roller on the blanket otherwise the tray will run dry. However, if the amount of coating material being delivered to the tray is too high, the tray will overflow with disastrous consequences to the press.

It is an object of this invention to provide a liquid coating supply system which will permit sufficient amount of liquid coating material to be delivered to the tray, but prevent the delivery of more material to the tray than can be taken away from the tray by the recirculation system.

The recirculation system disclosed herein prevents any possibility of the material being delivered to the tray in such quantities that the tray will overflow.

The liquid coating supply system constructed in accordance with this invention comprises a vessel for containing a supply of liquid coating material, a holding tray for holding a portion of the liquid coating material for pick up by a feed roller, a first liquid transfer means for transfering the liquid coating material from said supply vessel to said holding tray, and second liquid transfer means for transfering the liquid coating material from the holding tray to the supply vessel.

The first liquid transfer means includes an adjustable flow valve for regulating the liquid flow from the first liquid transfer means and a supply pump means between the supply vessel and the adjustable flow valve for withdrawing coating material from the supply vessel and for forcing the material through the valve under a pressure which is dependent upon the adjustment of the valve. This transfer means further includes a pressure responsive means between the pump and the adjustable valve for conducting the liquid flowing from the pump back to the supply vessel when the pressure between the pump and the adjustable valve exceeds a predetermined value.

The second liquid transfer means preferably also includes a supply pump means between the holding tray and the supply vessel for withdrawing the liquid coating material from the holding tray and forcibly pumping it into the supply vessel at a rate of flow which is at least equal to the rate of flow from the first liquid transfer means to the holding tray. The intake of this second transfer means is located above the bottom of the tray at the desired level at which the liquid is to be maintained in the tray. The discharge pump will withdraw the liquid coating material from the holding tray after the material in the tray rises to the level of the intake of the second transfer means.

It is preferred that the operating elements of the supply pump means and the discharge pump means be interconnected so that the operating elements will operate in unison with the strokes of the operating elements being substantially the same. In view of the adjustable valve at the discharge end of the first liquid transfer means and the pressure responsive means in that first liquid transfer means which transfers a portion of the fluid back to the supply vessel, the amount of fluid arriving at the holding tray from the first liquid transfer means will be less than the capacity of the second liquid transfer means to withdraw the liquid from the holding tray. As a result, the holding tray will never accumulate liquid coating material over a predetermined amount, i.e. over the level of the intake of the second transfer means, and it will never overflow.

BRIEF DESCRIPTION OF THE DRAWING

In the drawing FIG. 1 is a schematic view of the liquid coating supply system constructed in accordance with this invention.

DESCRIPTION OF THE PREFERRED EMBODIMENT

The liquid coating supply system of this invention is used to supply and recirculate liquid coating material which is applied in-line, that is, by one of the blanket cylinders of the printing press to the printed paper which is moving through the press. The coating, which is preferably a water-based coating, usually provides a high gloss to the printed product and gives paper and paperboard a good moisture barrier which is also resistent to grease and smearing by rubbing.

The coating material is applied to the blanket cylinder 10 of the printing press by means of a coater roller 12. The coating material in turn is applied to the coater roller by means of a feed roller 14, the bottom of which extends below the level of the liquid 16 in the liquid tray or pan 18. A discharge conduit 20 extends upwardly through the bottom of the tray 18. The upper end **20*a* of this discharge conduit forms the discharge port or liquid intake for the tray and is located at the level desired for the liquid level in the tray 18. The other end of the discharge conduit 20 is connected through a one-way valve 22 to one side of a double-delivery diaphragm pump 24, which will be further described herein. A discharge conduit 26 extends from a one-way valve 28 at the pump to the supply vessel 30 which holds a supply of the liquid coating material. The supply vessel 30 may conveniently be a 55-gallon drum. The liquid coating material 16 is pumped from the drum 30 by means of a first supply conduit 32 to the other side of the diaphragm pump 24 via a one-way valve 34. From the diaphragm pump, the coating material is pumped through a one-way valve 36 into a second supply conduit 38, the discharge end 38***a* of which extends above the liquid roller 14. Adjacent the discharge end of the conduit 38 is an adjustable flow valve 40. An adjustable pressure responsive valve 42, connected to the supply conduit 38 between the one-way valve 36 of the diaphragm pump and the adjustable flow valve 40, has a return conduit 44 which leads back to the supply vessel 30.

The diaphragm pump 24 is in reality two pumps which are connected together to operate in unison. One pump is a supply pump 24*a* having a diaphragm 46 and the other is a discharge pump 24*b* having a diaphragm 48. The two diaphragms are the operating elements of the pumps, and extending between these diaphragms is an operating rod 50. The operating rod 50 extends through an air cylinder 52 having a piston 54 which is connected to the rod 50. The operation of the air cylinder 52 and the piston 54 is governed by a fluid control means in the form of an air valve 56 having air lines 58 and 60 which are connected to the opposite sides of the air cylinder 52. A source of air pressure is connected to the air valve 56 by means of an air line 62, and an exhaust line 64 is provided for the valve 56.

The diaphragms 46 and 48 of the supply and discharge pumps respectively are thus connected together and moved in unison by the air cylinder piston 54 and the operating rod 50. When the operating rod 50 is moved to the right as illustrated in FIG. 1, the diaphragm 48 will be expanded to draw the coating fluid from the tray 18 through the conduit 20 into the space beneath the diaphragm. In this movement of the rod 50 to the right in FIG. 1, the diaphragm 46 is collapsed to cause the coating material beneath that diaphragm to move through the valve 36 and upwardly into the conduit 38. This movement of the rod 50 is caused by air pressure through the air line 58 and release of the air pressure through the air line 60 through the exhaust line 64 of the valve 56. When the valve 56 shifts to its opposite position, air line 60 is the conduit for the air pressure from the supply line 62 to the air cylinder 52 causing the piston 54 to move to the left as viewed in FIG. 1 carrying with it the rod 50. This will cause the diaphragm 48 of the discharge pump to collapse forcing the coating material through the conduit 26 and back into the supply vessel 30. At the same time, the diaphragm 46 of the supply pump expands drawing into the space beneath it the coating material from the supply vessel 30 through the supply conduit 32 and the one-way valve 34. Thus each movement of the rod 50 to the right in FIG. 1 withdraws the coating material from the tray 18 and pumps coating material to the tray through the conduit 38 and the adjustable flow valve 40. Movement of the rod 50 to the left in FIG. 1 causes the coating material to move from beneath the pump diaphragm 48 through the discharge conduit 26 into the supply vessel 30, and also causes the coating material to be drawn from the supply vessel into the space below the diaphragm 46 through the supply conduit 32 and the one-way valve 34.

The adjustable flow valve 40 is adjusted so that there is a pressure within the supply conduit 38 and the pressure responsive valve 42 is adjusted so that on each downstroke or collapsing of the diaphragm 46 of the supply pump 24*a* a portion of the coating material passing through the supply conduit 28 overcomes the resistance of the pressure responsive valve and flows back into the supply vessel 30 through the return conduit 44.

The adjustable flow valve 40 is thus intended to create a pressure within the supply conduit 38 so that a portion of the liquid coating material 16 will always flow back to the supply vessel 30 and the amount of this fluid flowing from the discharge end 38*a* of the supply conduit 38 will thus be less than the material which could be drawn through the discharge conduit 20 by the diaphragm 48 of the discharge pump. In other words, the supply pump and discharge pumps are equal in their capacity, but since a portion of the material which enters the supply conduit 38 is actually returned to the supply vessel through the pressure responsive valve 42 and the conduit 44, the capacity of the system on the supply side in delivering the coating material to the tray 18 is less than the capacity of the system on the discharge side to remove the material from the tray. In this way there is no danger that the tray 18 will receive more liquid coating material than it can take away and there is no danger in the tray 18 overflowing to cause difficulties in the press.

It will be appreciated that with the liquid discharge capacity exceeding the liquid supply capacity, the liquid level in the tray 18 will always be maintained at the level of the end 20*a* of the discharge conduit. This, of course, means that at times the discharge pump 24*b* may be pumping air or a mixture of air and coating material. The pump must be capable of doing this.

The foregoing description is given by way of example and it will be appreciated that a number of modifications may be made in the details of the invention as described herein without departing from the spirit of the invention as hereinafter claimed.

What is claimed is:

1. A liquid coating supply system for a printing press blanket coater, said system comprising, a vessel for holding a supply of liquid coating material, a holding tray for holding a portion of the liquid coating material for pick up by a feed roller, first liquid transfer means for transfering liquid coating material from said supply vessel to said holding tray, and second liquid transfer means, including a discharge pump means intermediate said holding tray and said supply vessel for withdrawing liquid coating material from said holding tray and forcibly pumping it into said supply vessel at a rate of flow which is at least equal to the rate of flow from said first liquid transfer means to said holding tray, and said second liquid transfer means having an intake within said holding tray above the bottom of said tray whereby said discharge pump means will withdraw the liquid coating material in the tray above the level of said second transfer means intake, said first liquid transfer means comprising an adjustable flow valve for regulating the liquid flow from said first liquid transfer means, supply pump means intermediate said supply vessel and said adjustable flow valve for withdrawing liquid coating material from said supply vessel and for forcing the liquid coating material through said valve under a pressure which is dependent upon the adjustment of said valve, and pressure responsive means intermediate said pump and said adjustable valve for conducting the liquid coating material flowing from said pump back to said supply vessel when the pressure between said pump and adjustable valve exceeds a predetermined value.

2. The structure of claim 1 wherein said supply pump means and said discharge pump means each have at least one movable operating element for contacting the liquid coating material and forcing it through the associated transfer means, and drive means is provided operatively interconnecting the operating elements of said supply pump means and said discharge pump means, whereby said operating elements will operate in unison.

3. The structure of claim 2 wherein said drive means includes a pressurized fluid source, a fluid driven reciprocating piston operatively connected to the operating elements of each of said pump means, and a fluid control intermediate said fluid source and said drive means for connecting the pressurized fluid source alternatively to each side of said reciprocating piston.

4. The structure of claim 3 wherein the operating elements of said pump means are diaphragms.

5. The structure of claim 5 wherein the strokes of the operating elements of said supply pump means and of said discharge pump means are substantially the same but the amount of liquid coating material arriving at said holding tray from said first liquid transfer means is less than the capacity of the second liquid transfer means to withdraw the liquid coating material from the holding tray.

* * * * *